US008066066B2

(12) United States Patent
Linaker

(10) Patent No.: US 8,066,066 B2
(45) Date of Patent: Nov. 29, 2011

(54) BOREHOLE CASING CENTRALISER

(75) Inventor: Jason Linaker, Bunbury (AU)

(73) Assignee: Kwik-Zip Pty Ltd, Bunbury (AU)

( * ) Notice: Subject to any disclaimer, the term of this patent is extended or adjusted under 35 U.S.C. 154(b) by 0 days.

(21) Appl. No.: 13/007,268

(22) Filed: Jan. 14, 2011

(65) Prior Publication Data

US 2011/0168388 A1 Jul. 14, 2011

Related U.S. Application Data

(63) Continuation of application No. PCT/AU2009/000846, filed on Jun. 30, 2009.

(30) Foreign Application Priority Data

Jul. 15, 2008 (AU) ..... 2008903605

(51) Int. Cl.
*E21B 17/10* (2006.01)

(52) U.S. Cl. ..... 166/241.1; 161/241.6; 175/325.5

(58) Field of Classification Search ..... 166/241.1, 166/241.6, 172; 175/325.2, 325.5
See application file for complete search history.

(56) References Cited

U.S. PATENT DOCUMENTS 4,641,776 A 2/1987 Vlasek et al.
6,367,556 B1 * 4/2002 Moore ..... 166/378
6,637,511 B2 * 10/2003 Linaker ..... 166/241.7
7,048,064 B1 * 5/2006 Smith ..... 166/382

FOREIGN PATENT DOCUMENTS

AU 200143778 11/2001
WO WO 2006/021152 3/2006

* cited by examiner

*Primary Examiner* — Kenneth L Thompson
*Assistant Examiner* — Yong-Suk Ro
(74) *Attorney, Agent, or Firm* — Edwards Wildman Palmer LLP; Kathleen Williams; Richard B. Emmons

(57) ABSTRACT

A centraliser segment (11) comprising a first collar portion (15), a second collar portion (17) and bow element (19) extending between said first collar portion and said second collar portion to maintain the collar portions in spaced relation to each other, said bow portions having an intermediate portion which lies to one side of the plane accommodating the collar portions, a first connector element (21) provided at one end of the collar portions and second connector element (23) provided at the other end of the collar portions, said first connector elements are engagable with said second connector elements of the same or another centraliser segment such that one or more said centraliser segments are connectable together to form a centraliser which in use is capable of being received around a borehole casing, said first and second connector element having an adjustment element which can cause the diameter of the centraliser can be varied by operation of the adjustment element (41) wherein the adjustment is controllably and continuously variable over a range of diameters.

19 Claims, 10 Drawing Sheets

BOREHOLE CASING CENTRALISER

RELATED APPLICATIONS

This application is a continuation of PCT patent application number PCTAU2009/000846, filed on Jun. 30, 2009, which claims priority to Australian Patent Application No.: 2008903605, filed on Jul. 15, 2008, the entirety of each of which are herein incorporated by reference.

The present invention relates to a centraliser segment and a centraliser formed of one or more of such centraliser segments.

BACKGROUND

One application of the centraliser is to centralise a borehole casing. Such borehole casings may be used, for example, in water wells, oil wells and gas wells. A centraliser which has been previously proposed by the inventor is disclosed in AU200143778. In locating the centraliser in position it is necessary to adjust the diameter of the centraliser in order that it becomes snugly supported around the borehole casing.

The discussion throughout this specification, of the background and prior art to the invention is intended only to facilitate an understanding of the present invention. It should be appreciated that the discussion is not an acknowledgement or admission that any of the material referred to was part of the common general knowledge in Australia and the world as at the priority date of the application.

DISCLOSURE OF THE INVENTION

Throughout the specification and claim, unless the context requires otherwise, the word "comprise" or variations such as "comprises" or "comprising", will be understood to imply the inclusion of a stated integer or group of integers but not the exclusion of any other integer or group of integers.

In accordance with one aspect of the present invention, there is provided centraliser segment comprising a first collar portion, a second collar portion, said collar portions having an inner face and an outer face, the centraliser segment further comprising at least one bow element extending between said first collar portion and said second collar portion to maintain the collar portions in spaced relation to each other, said bow portions being curved between the collar portions to provide an intermediate portion which is in spaced relation from the outer face of the collars, a first connector element provided at one end of each of the collar portions wherein the first connector element comprises a passage formed along the respective collar portion to extend inwardly from the respective end and second connector element provided at the other end of each of the collar portions the second connector element comprising an elongate element which in use is able to be received in the passage to be slidable along the passage, wherein said first connector elements are engagable with said second connector elements of the same or another centraliser segment such that one or more said centraliser segments able to form a centraliser which in use is capable of being received around a borehole casing, said first connector element having an adjustment element cooperating with the passage and the elongate member to control the position of the elongate member within the passage, wherein the adjustment element comprises a threaded element rotatably supported adjacent the passage and wherein the elongate member is formed with a set of serrations along at least a portion of its length, the spacing between the serrations conforming to the thread of the threaded element, wherein in use when the elongate member is received in the passage the thread of the threaded member is engaged with the serrations such that rotation of the threaded member causes relative displacement between the passage and the elongate element.

According to a preferred feature of the invention the passage comprises a channel formed in the inner face of the respective collar portions.

According to a preferred feature of the invention the threaded member is rotatable about an axis which is inclined with respect to the axis of the passage and a portion of the thread extends into the passage. According to a preferred feature of the invention one end of the threaded member is supported upon a spigot which is received in a hollow bore of the traded member. According to a preferred feature of the invention the first connector element is formed as a housing at the one end of the collar, said passage being formed at an inner face of the housing and being a continuation of the inner face of the collar. According to a preferred feature of the invention the passage is formed in part by a passageway at the one end of the collar, said passageway being configured to slidingly receive the elongate element.

According to a preferred feature of the invention the passage is formed in part by a pair of side elements located at the one end of the collar and located to each side of the inner face, each side element having an inwardly directed flange at their outer edge, the spacing between the side portions corresponding at least to the width of the elongate element and the spacing between the flanges and the inner face corresponding at least to the thickness of the elongate element.

According to a preferred feature of the invention wherein the at least bow element is flexibly resilient. According to a preferred feature of the invention the at least one bow element has an outer face having a convex transverse profile. According to a preferred feature of the invention the at least one bow element has a channel shaped cross section . According to a preferred feature of the invention the edges of the flanges of the channel section are provided with laterally directed flanges.

According to a preferred feature of the invention said at least one bow element comprises at least two strap members extending between said first and second collar portions.

According to a preferred feature of the invention wherein said first and second collar portions are substantially parallel.

According to a preferred feature of the invention said first and second collar portions are provided as strap-like members.

According to a preferred feature of the invention said centraliser segment is made of a corrosion resistant material.

According to a preferred feature of the invention the inner face of at least one of the connectors and/or the collars is provided with a surface which has a high coefficient of friction with the borehole casing. the surface is provided by at least one pad applied to at least one of the connectors and/or the collars.

According to another aspect the invention resides in a centraliser for a borehole casing comprising a centraliser segment, as described above wherein the ends of the centraliser segments are connected together via said first and second connector element around a borehole casing.

According to another aspect the invention resides in comprising at least two centraliser segments, as described above wherein the ends of the centraliser segments are connected together via said first and second connector element around a borehole casing.

The invention will be more fully understood in the light or the following description of one specific embodiment.

BRIEF DESCRIPTION OF THE DRAWINGS

The description is made with reference to the accompanying drawings, in which.

DETAILED DESCRIPTION OF SPECIFIC EMBODIMENT

Figure 1:
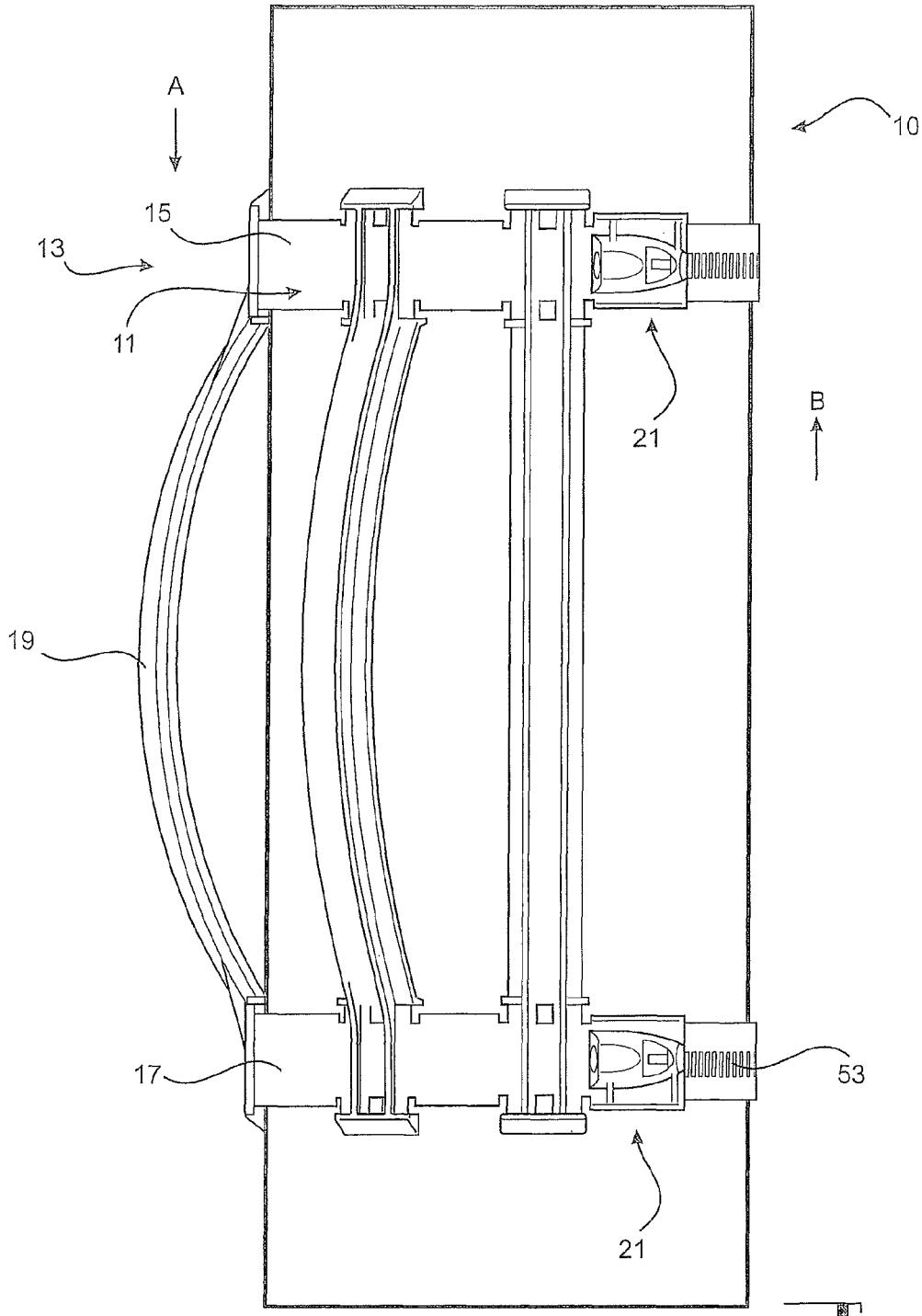
FIG. 1 is a perspective view of a centraliser according in position around a borehole casing.
Figure 2:
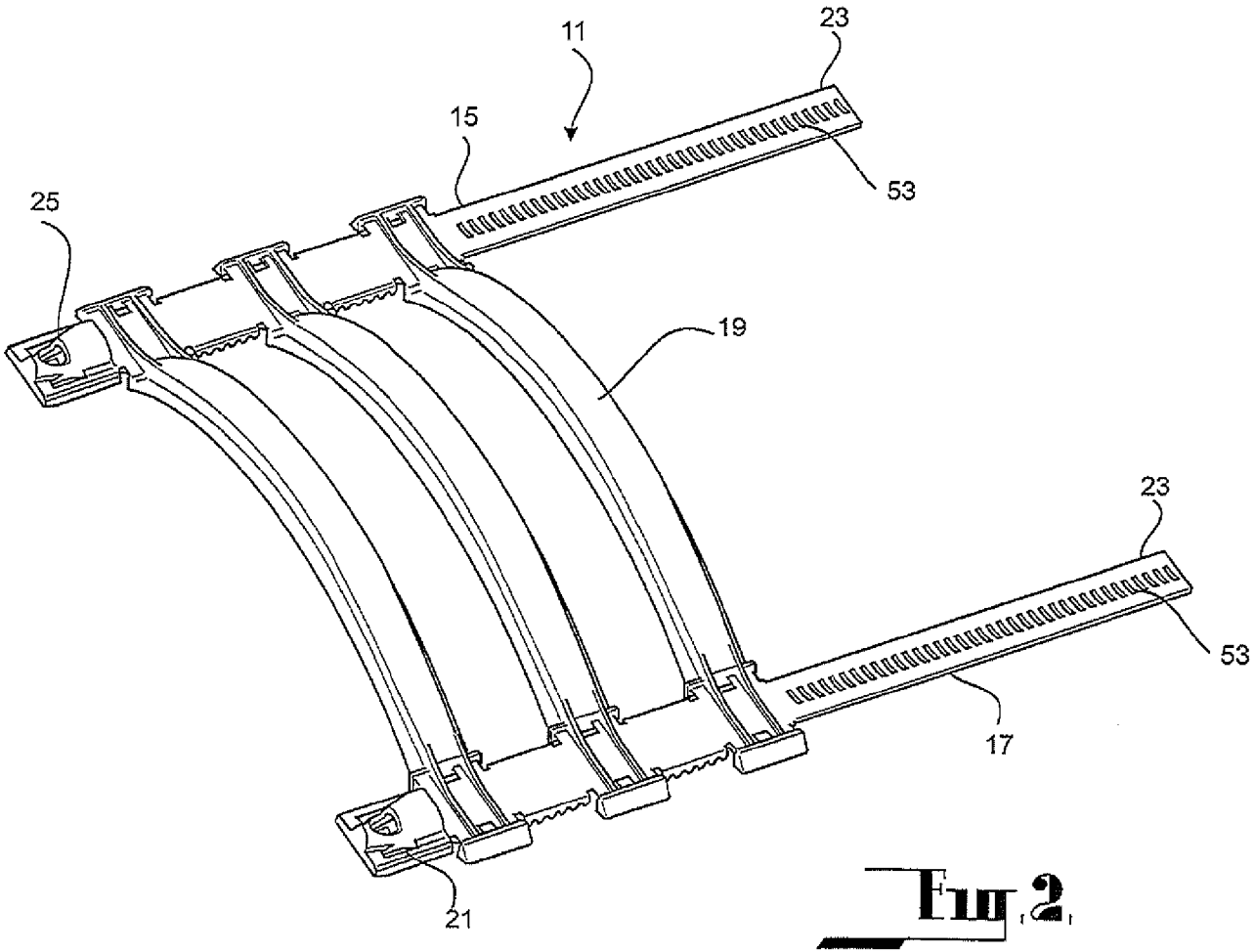
FIG. 2 is an upper isometric view of a centraliser segment according to the embodiment.
Figure 3:
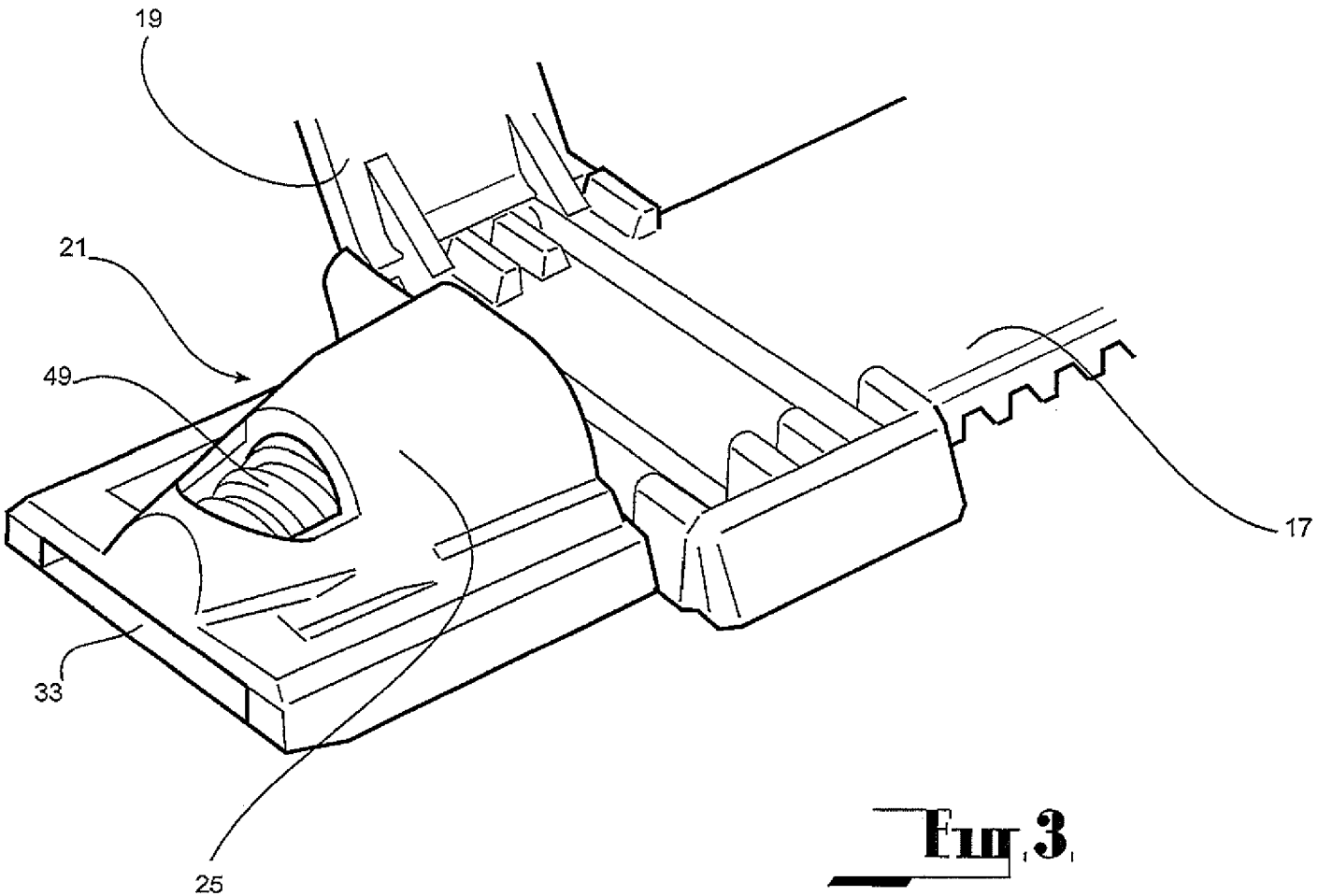
FIG. 3 is an enlarged upper isometric partial view of the centraliser segment of FIG. 2 showing the first connector of the embodiment.
Figure 4:
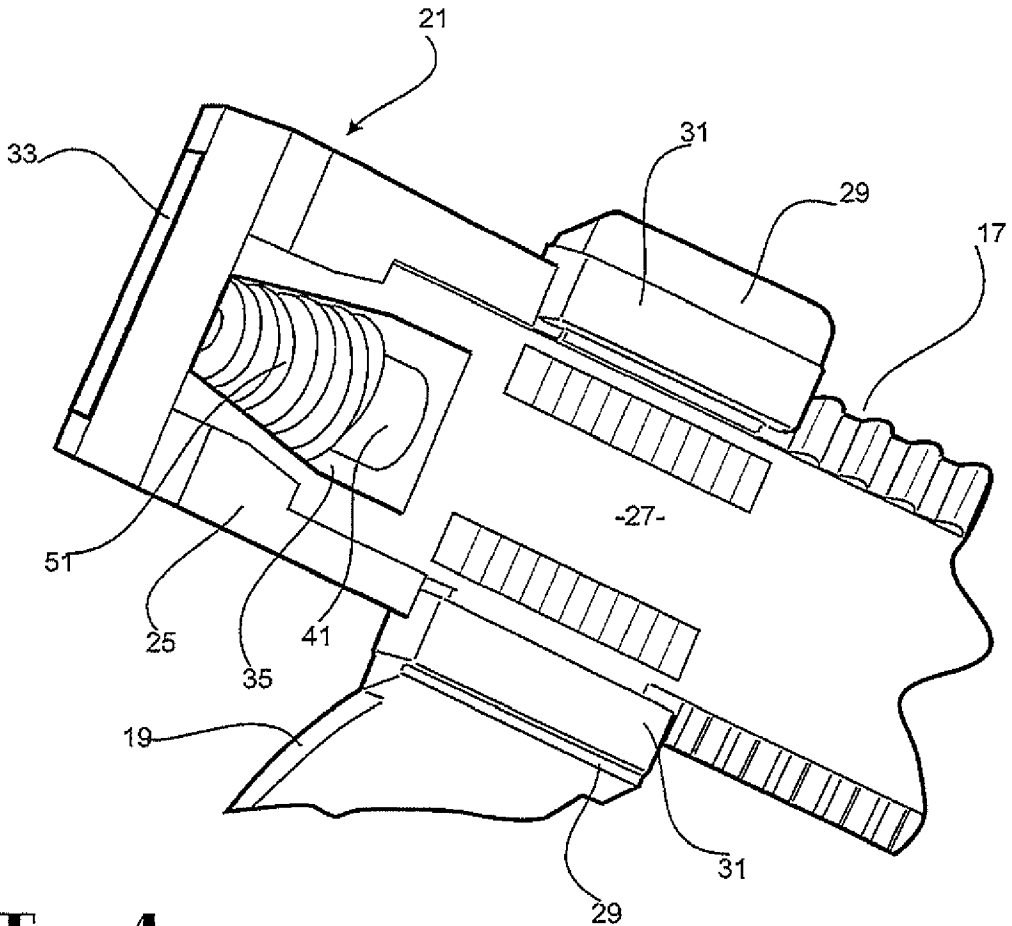
FIG. 4 is an enlarged lower isometric partial view of the centraliser segment of FIG. 2 showing the first connector of the embodiment.

The embodiment comprises a centraliser segment 11 whereby the ends of a single segment or a set of interconnected segments are connected together to form an annular centraliser 13 which in use is to be located around a borehole casing 10 (as shown at FIG. 1) to centralise the casing within a borehole. The use of a set of interconnected segments to form a centraliser 13 is required with borehole casings having medium to large diameters, whilst the use of a single segment to form the centraliser 13 of is appropriate with borehole casings having small diameters. The centralisers 13 are formed of a suitable plastics material which is resistant to corrosion and has sufficient rigidity and resilience to perform its function as a centraliser.

Figure 7:
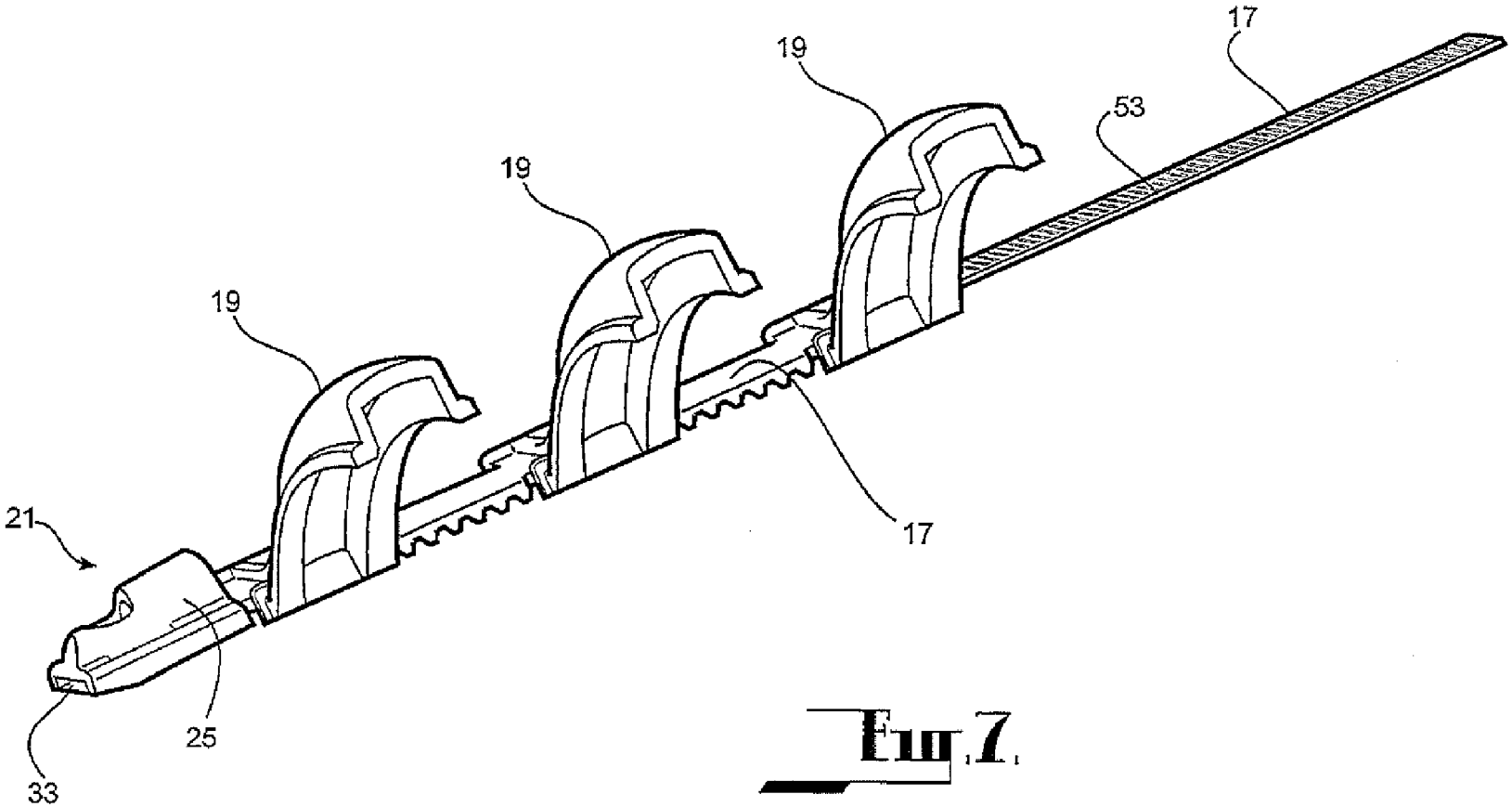
FIG. 7 is a sectional partial isometric view of the centraliser segment according to the embodiment.

The centraliser segment 11 according to the embodiment comprises a first collar portion 15 and a second collar portion 17 which are held in spaced parallel relationship by a set of substantially parallel bows 19, which extend between the first and second collar portions 15 and 17. The bows 19 are elongate members which are curved along their length such that the central portion of the bows 19 is spaced outwardly from the plane of the outer face of the centraliser segment. In addition and as shown in FIG. 7 each bow is formed as channel section whereby the open face of the channel is facing inwardly in use. The outer edges of the channel section are formed with outwardly directed flanges. When the centraliser 13 is mounted to the casing 10 (as shown at FIG. 1) the collar portions 15 and 17 snugly engage the casing while the bows 19 extend outwardly from the side of the casing to locate the casing centrally within the bore hole.

Each end of each collar portion is provided with connector element 21 and 23 where the connector elements on each collar are the same and the and the connector elements on each collar are complementary to each other and enable the ends to be lockingly interconnected and the diameter of the resultant centraliser 13 to be varied.

The first connector elements 21 which are provided at one end of both collar portions comprises a housing 25 which is formed as an integral element at the end of the collar. The housing has an inner face 27 which is a continuation of the inner face of the collar. The end of the housing at its junction with the collar is formed with a pair of opposed side elements 29 which are in use to be located to each side of the collar and are each provided with an inwardly directed flange 31 at its outer edge. The spacing between the side elements 29 and the spacing between the flanges and the opposed inner face of the housing are dimensioned to be able to snugly and slidingly receive the other end of the collar. The other end of the housing is provided with a passageway 33 which is dimensioned and positioned to receive the other end of the collar. The inner face 27 of the housing 25 together with the side elements 29 and their flanges 31 jointly with the passageway 33 combine to define a passage which in use will receive the other end of the collar.

At a position inward of the passage way 33 the inner face of the housing 25 is formed with an opening 35. The outer portion of the housing 25 provided on the outer face with a tubular boss 37 which is formed with a longitudinal passage 39 of circular cross-section. The longitudinal passage 39 is located such that it overlies the opening 35 and has an open side face which opens into the opening 35 The central axis of the longitudinal passage 39 is inclined with respect to the inner face of the housing and as result in the region of the opening 35 the longitudinal passage 39 is part circular in cross section and is truncated by the inner face at the side adjacent the opening 35.

Figure 5:
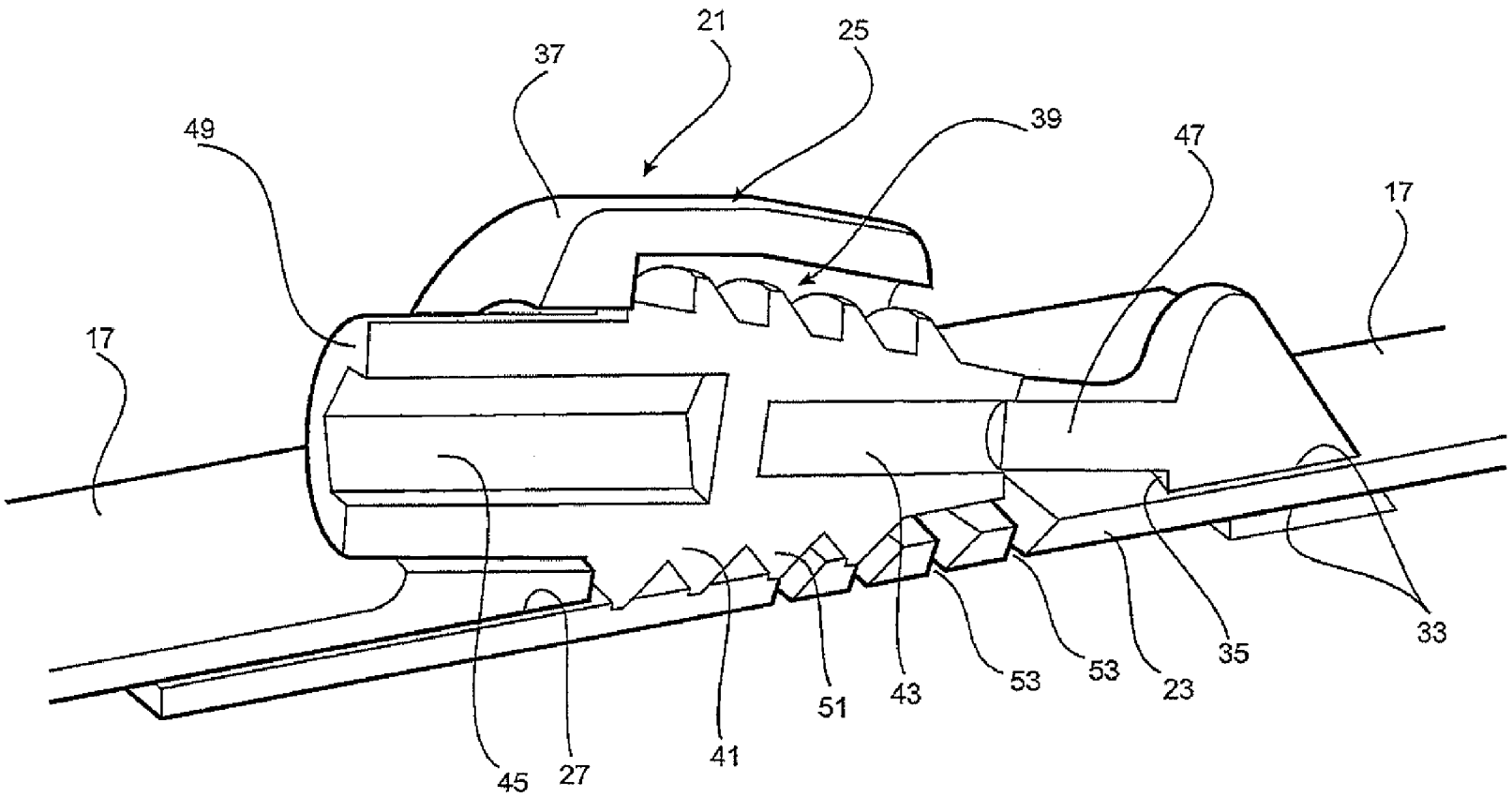
FIGS. 5 is a sectional isometric view of the first and second connectors of the embodiment interconnected with the stud in the retracted position.
Figure 6:
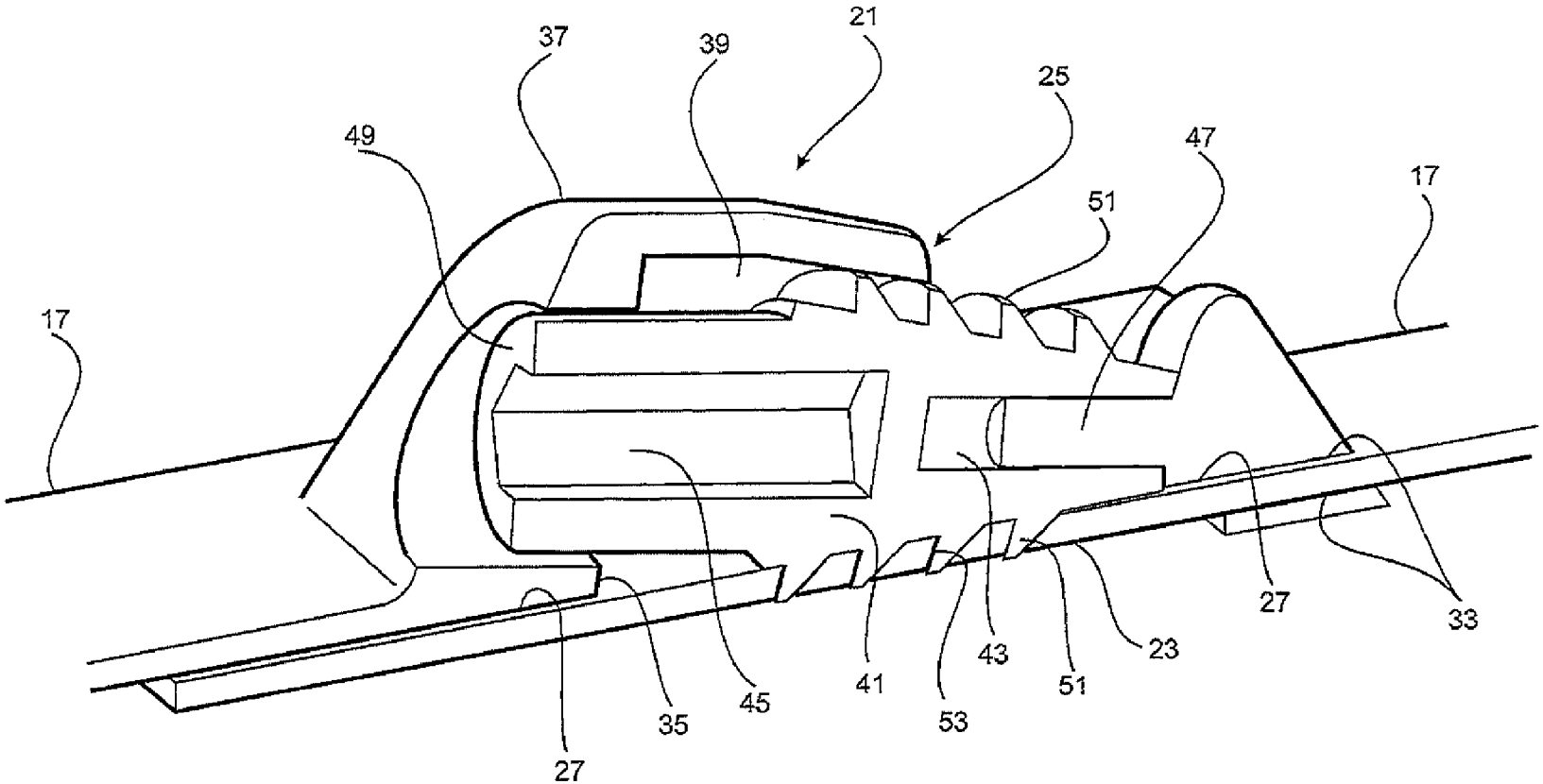
FIGS. 6 is a sectional isometric view of the first and second connectors of the embodiment interconnected with the stud in the extended position.

The longitudinal passage 39 is associated with a threaded stud 41 which is receivable in the longitudinal passage 39 to be rotatable within the longitudinal passage 39. The stud is formed with a hollow bore 43 and 45 and the inner end of stud is associated with a spigot 47 which is positioned in opposed relation to the inner end of the stud and is receivable in the inner hollow bore 43 of the stud. The outer end 49 of the stud is accessible through the outer end of the longitudinal passage and the bore 45 at the outer end is formed to be able to receive an Allen key. The side face of the stud between the ends is formed with a conical thread 51. The stud is slidable longitudinally within the passage. As a result of the relative inclination of the longitudinal passage 39 relative to the inner face, the conical configuration of the thread carried by the stud and the capacity of the stud for relative movement in the passage the thread 51 is movable between a retracted position as shown at FIG. 5 at which the thread is fully accommodated within the passage and an extended position at which a portion of the stud extends laterally into the opening 35 and beyond the inner face 27 of the housing as shown at FIG. 6.

The second connector elements 23 is formed at the other end of the collar as a tongue like extension of the collar and is dimensioned and configured to be slidably receivable between the side elements 29 and between the flanges 31 and the inner face 27 of the housing and through the passageway 33. The face of the extensions which will abut the inner face 27 of the housing is formed with a set of spaced transverse slots 53 which are spaced to correspond with the pitch of the thread 51 of the stud 41. When the extensions are located in engagement with the respective housing the slots are engaged by the portion of thread 51 of the stud 41 which extends beyond the inner face 21 of the housing when the stud is in the extended position as shown at FIG. 6. When the stud is in the retracted position the thread 51 is out of engagement with the slots 53 as shown at FIG. 5. When second connector is received by the housing and the thread of the stud 41 is engaged with the slots 53 on the extension, rotation of the stud will cause relative displacement between the respective ends of the collar. As a result when a pair of ends of a centraliser segment 11 according to the invention are interconnected to form a centraliser 13 the diameter of the centraliser 13 can be varied by rotation of the stud 33.

To improve the grip between the centraliser and the bore casing the inner face of the housing is provided with pads (not shown) which can be formed of a suitable elastomeric composition which has high frictional coefficient when applied to the bore casing. The pads are applied to the portion of the housing defining the underside of the flanges 31 and/or the passage 33

Figure 8:
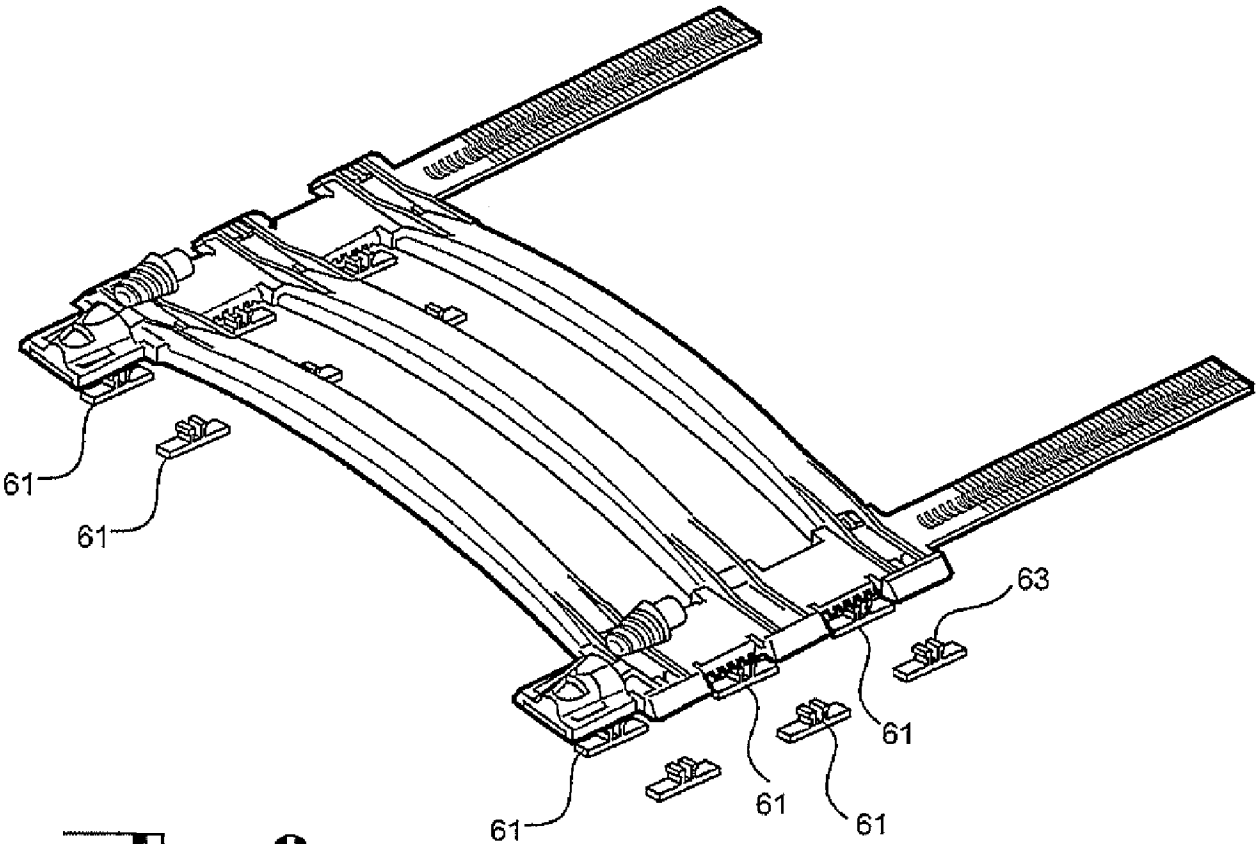
FIG. 8 is an isometric view of a second embodiment of the invention showing the pads in an exploded view.
Figure 9:
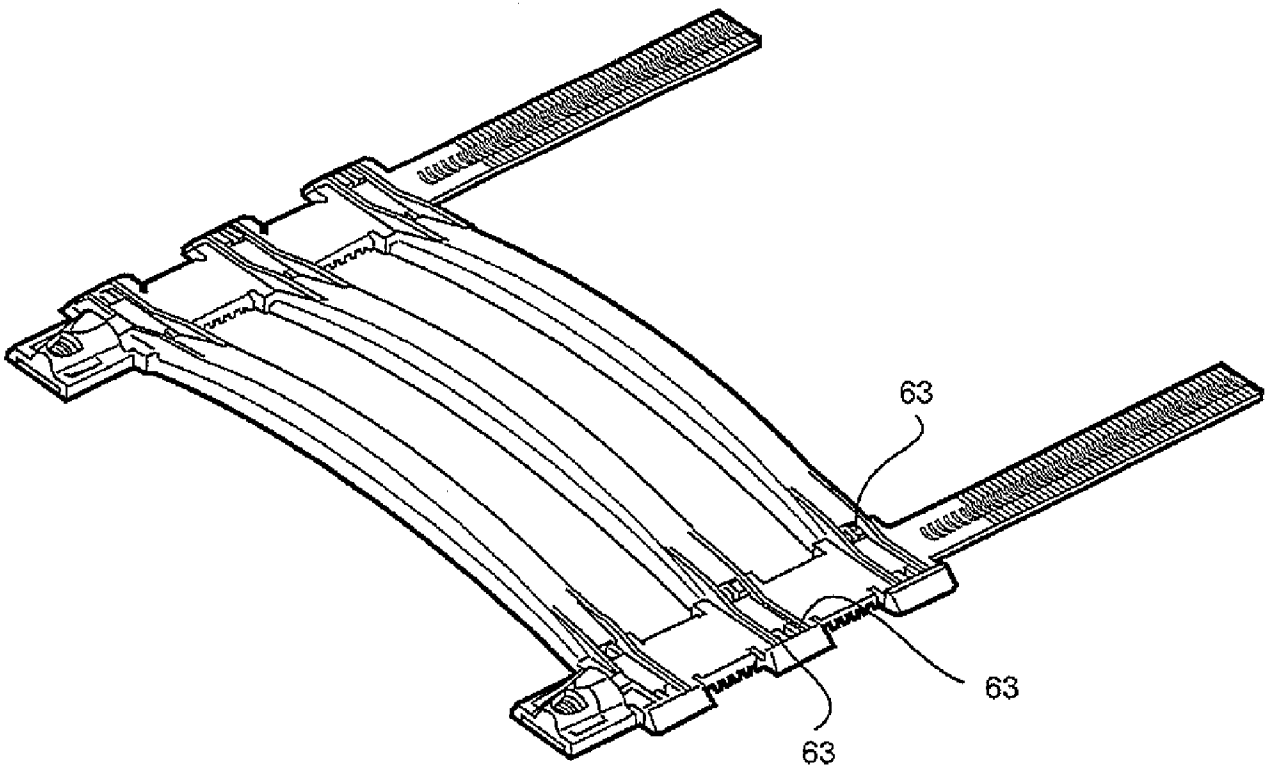
FIG. 9 is an isometric view of a second embodiment of the invention showing the pads in position.
Figure 10A:
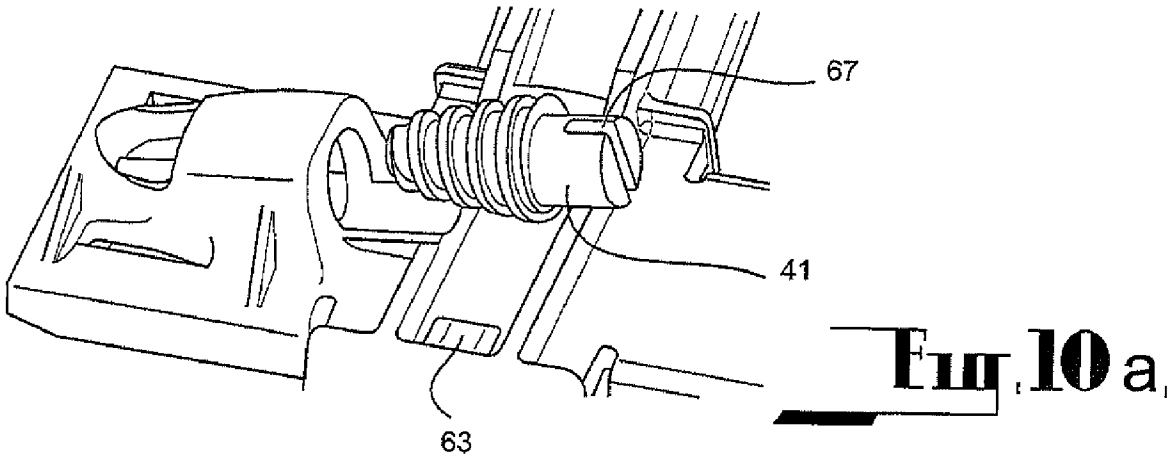
FIGS. 10*a*, 10*b* and 10*c* are partial isometric views showing the housing and stud of the second embodiment.
Figure 10B:
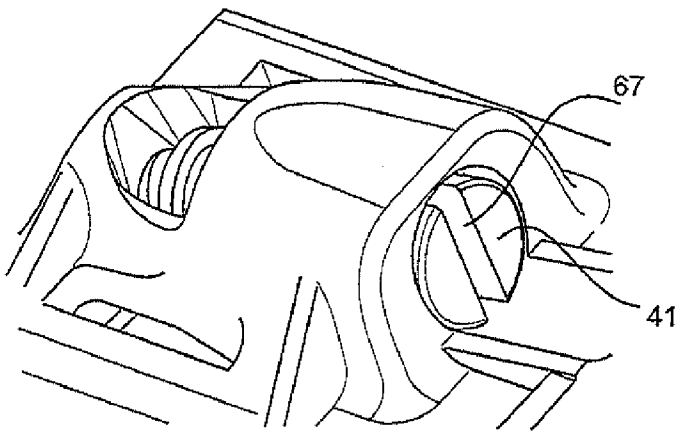
Figure 10C:
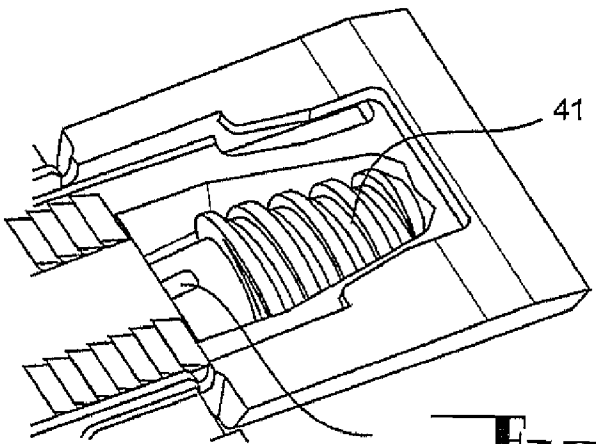

A second embodiment of the invention is illustrated at FIGS. 8 9 and 10-. The embodiment takes the same form as that of the first embodiment. The differences in the second embodiment relate to the pads 61 which are provided on the inner face of the housing the pads 61 are formed of an elastomeric material and are configured to be engageable with apertures 63 provided in the housing. To this effect the pad is formed with a pair of tabs 65 which are received in the apertures to be retained by the housing. In addition as shown at FIG. 9 the outer end of the stud 41 is provided with a slot 67 rather than the hexagonal bore 45 to enable the adjustment of the centraliser to be able to be effected with a conventional screw driver.

The manner of operation and use of the centraliser segment of each of the embodiments of the invention will now be described.

The centraliser 13 is fixed around the borehole casing 10 prior to the borehole casing 10 being inserted into a borehole. In the case of small diameter casings a single centraliser segment can be used and in the case of larger diameter casings two or more centraliser segments 11 are able to be connected together end to end via the first and second connectors 21 and 23. The free ends of the single centraliser segment or of a set of interconnected centraliser segments are interconnected to form a centraliser 13. The interconnection between the ends is effected by engaging the extensions of the second connectors with the housing 25 of the first connectors and with the studs in their retracted condition the centraliser can be readily adjusted to the diameter of the bore casing. The final adjustment of the centraliser and its tightening on the borehole casing is effected by pushing the stud to the extended position to bring the thread 51 into engagement with the slots and by rotation of the stud 41 using an Allen key in the case of the first embodiment and a screwdriver in the case of the second embodiment. The Allen key or screw driver respectively is received in the outer end of the bore of the stud 41. As the extensions which define the second connectors will abut the inner face of the housing they will be received between the inner face of the housing and the borehole casing and therefore do not have to be trimmed on the completion of the installation of the centraliser on the borehole casing.

A borehole casing 10 is generally made by connecting lengths of tubing together as the borehole casing 10 is inserted deeper into the borehole. Typically, the casing lengths are six or nine metres in length and a centraliser 13 can be provided every few metres along the length of the borehole casing 10. The centralisers are located at spaced intervals along the borehole casing. The spacing of the centralisers will be dependent upon the application. For instance it is usual that where the borehole is horizontal the spacings will be less than in instances where the borehole is vertical.

Due to the bows 19 being flexibly resilient, as the borehole casing 10 is pushed into the borehole, the bows 19 will resiliently deform if they encounter any obstruction in the wall of the borehole and once the bows 19 pass over the obstruction, they will return to their normal undeformed position to maintain contact with the wall borehole. Maintaining the bows 19 in contact with the wall of the borehole ensures that the borehole casing 10 remains centralised as it is inserted into the borehole.

Once the borehole casing 10 is in position in the borehole, a grout discharge pipe can be lowered down the borehole casing 10 and grout is then discharged from the opening of the grout discharge pipe so that it flows into the annular space between the borehole casing and the walls of the borehole. Once the grout has set, the borehole casing remains centralised in the borehole and can be used for its intended purpose.

The present invention is not to be limited in scope by the specific embodiment described herein. The embodiment is intended for the purpose of exemplification only. Functionally equivalent products, formulations and methods are clearly within the scope of the invention as described herein.

The invention claimed is:

1. A centraliser segment comprising a first collar portion, a second collar portion said collar portions having an inner face and an outer face, the centraliser segment further comprising at least one bow element extending between said first collar portion and said second collar portion to maintain the collar portions in spaced relation to each other, said bow portions being curved between the collar portions to provide an intermediate portion which is in spaced relation from the outer face of the collars, a first connector element provided at one end of each of the collar portions wherein the first connector element comprises a passage formed along the respective collar portion to extend inwardly from the respective end and second connector element provided at the other end of each of the collar portions the second connector element comprising an elongate element which in use is able to be received in the passage to be slidable along the passage, wherein said first connector elements are engagable with said second connector elements of the same or another centraliser segment such that one or more said centraliser segments are able to form a centraliser which in use, is capable of being received around a borehole casing, said first connector element having an adjustment element cooperating with the passage and the elongate member to control the position of the elongate member within the passage, wherein the adjustment element comprises a threaded element rotatably supported adjacent the passage and wherein the elongate member is formed with a set of serrations along at least a portion of its length, the spacing between the serrations conforming to the thread of the threaded element, wherein in use when the elongate member is received in the passage the thread of the threaded member is engaged with the serrations such that rotation of the threaded member causes relative displacement between the passage and the elongate element.

2. The centraliser segment as claimed at claim 1 wherein the passage comprises a channel formed in the inner face of the respective collar portion.

3. The centraliser segment as claimed at claim 1 wherein the threaded member is rotatable about an axis which is inclined with respect to the axis of the passage and a portion of the thread extends into the passage.

4. The centraliser segment as claimed at claim 1 wherein one end of the threaded member is supported upon a spigot which is received in a hollow bore of the threaded member.

5. The centraliser segment as claimed at claim 1 wherein the first connector element is formed as a housing at the one end of the collar, said passage being formed at an inner face of the housing and being a continuation of the inner face of the collar.

6. The centraliser segment as claimed at claim 1 wherein the passage is formed in part by a passageway at the one end of the collar, said passageway being configured to slidingly receive the elongate element.

7. The centraliser segment as claimed at claim 1 wherein the passage is formed in part by a pair of side elements located at the one end of the collar and located to each side of the inner face, each side element having an inwardly directed flange at their outer edge, the spacing between the side portions corresponding at least to the width of the elongate element and the spacing between the flanges and the inner face corresponding at least to the thickness of the elongate element.

8. The centraliser segment as claimed at claim 1 wherein the at least one bow element is flexibly resilient.

9. The centraliser segment as claimed at claim 1 wherein the at least one bow element has an outer face having a convex transverse profile.

10. The centraliser segment as claimed at claim 9 wherein the at least one bow element has a channel shaped cross section.

11. The centraliser segment as claimed at claim 10 wherein the edges of the flanges of the channel section are provided with laterally directed flanges.

12. The centraliser segment as claimed at claim 1 wherein said at least one bow element comprises at least two strap members extending between said first and second collar portions.

13. The centraliser segment as claimed at claim 1 wherein said first and second collar portions are substantially parallel.

14. The centraliser segment as claimed at claim 1 wherein said first and second collar portions are provided as strap-like members.

15. The centraliser segment as claimed at claim 1 wherein said centraliser segment is made of a corrosion resistant material.

16. The centraliser segment as claimed at claim 1 wherein the inner face of at least one of the connectors and/or the collars is provided with a surface which has a high coefficient of friction with the borehole casing.

17. The centraliser segment as claimed at claim 16 wherein the surface is provided by at least one pad applied to at least one of the connectors and/or the collars.

18. The centraliser for a borehole casing comprising a centraliser segment, as claimed at claim 1 wherein the ends of the centraliser segment are connected together via said first and second connector element around a borehole casing.

19. The centraliser for a borehole casing comprising at least two centraliser segments, as claimed at claim 1 wherein the ends of the centraliser segments are connected together via said first and second connector element around a borehole casing.

* * * * *